US005129655A

United States Patent [19]

Gillespie et al.

[11] Patent Number: 5,129,655

[45] Date of Patent: Jul. 14, 1992

[54] TOKEN MOVING GAME WITH SPINNING DISRUPTER

[75] Inventors: Michael R. Gillespie, Chicago; Donald A. Rosenwinkel; John V. Zaruba, both of Oak Park, all of Ill.; Douglas Harrison, Newburyport; Thomas N. Fenton, Gloucester, both of Mass.

[73] Assignee: Breslow, Morrison, Terzian & Associates, Inc., Chicago, Ill.

[21] Appl. No.: 652,867

[22] Filed: Feb. 8, 1991

[51] Int. Cl.[5] ..... A63F 3/00; A63H 1/02; A63H 1/28

[52] U.S. Cl. ..... 273/241; 273/249; 273/287; 446/256; 446/260

[58] Field of Search ..... 273/242, 147, 243, 248, 273/249, 287, 86 C; 446/256, 259, 260

[56] References Cited

U.S. PATENT DOCUMENTS

| | | | |
|---|---|---|---|
| 907,421 | 12/1908 | Steinhardt et al. | 273/241 |
| 2,818,675 | 1/1958 | Glass et al. | 446/260 |
| 3,649,021 | 3/1972 | Hayes | 273/243 |
| 4,206,925 | 6/1980 | Goldfarb et al. | 273/248 |
| 4,333,655 | 6/1982 | Rudell et al. | 273/241 |
| 4,348,028 | 9/1982 | Barlow | 273/249 |
| 4,852,886 | 8/1989 | Zaruba et al. | 273/249 |
| 4,932,918 | 6/1990 | Onoda | 446/260 |

FOREIGN PATENT DOCUMENTS

| | | | |
|---|---|---|---|
| 548571 | 1/1923 | France | 446/256 |
| 2028148 | 3/1980 | United Kingdom | 273/241 |

*Primary Examiner*—Benjamin Layno
*Attorney, Agent, or Firm*—Dick and Harris

[57] ABSTRACT

A path game including a generally serpentine path rising from a start to a higher finish. Removably seated adjacent the finish is a top together with a winding and release mechanism for the top. Card play provides for forward and backward movement of tokens, exchange of tokens with opposing players and release of the spinning top. When the mechanism is removed, the top may be readily mounted on the winding and release mechanism for winding. The wound top, together with the winding and release mechanism is then reseated for release upon play of a particular type of card. Upwardly projecting ridges between segment of the path generally provide a guide for downward movement of the released spinning top along the path. Gaps in the ridges provide for movement of the top from one segment of the path to a nonconsecutive segment while skipping intervening consecutive segment and also permit the top to leave the path entirely.

14 Claims, 2 Drawing Sheets

Fig 4
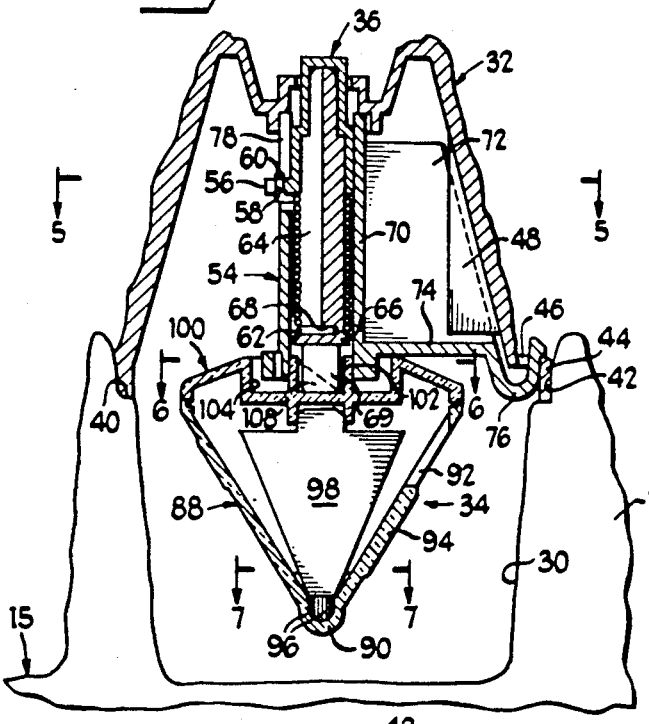
Fig 2
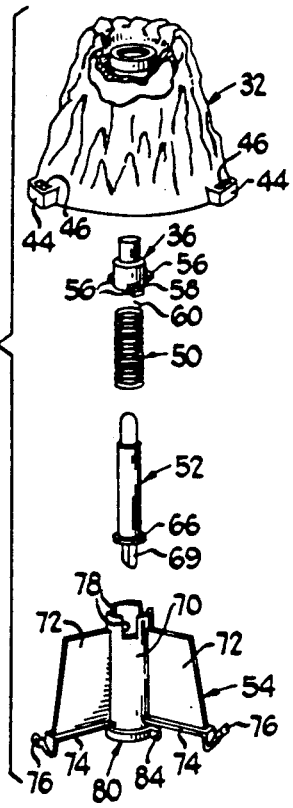
Fig 5
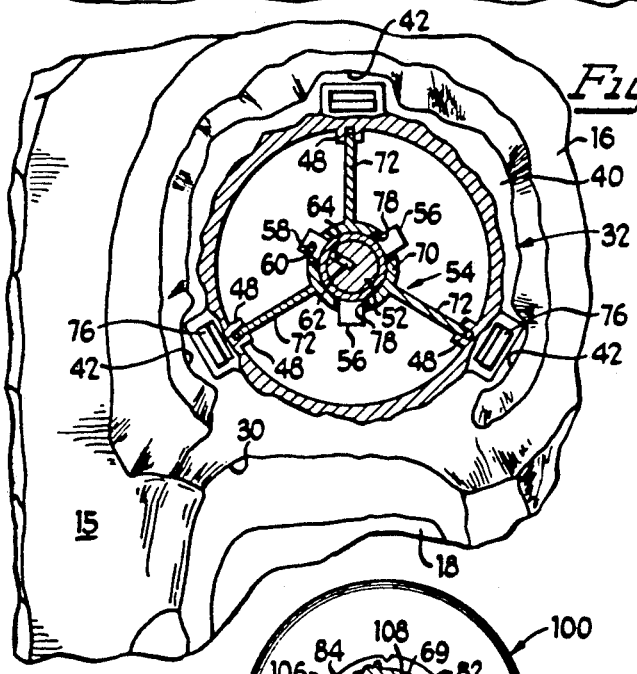
Fig 3
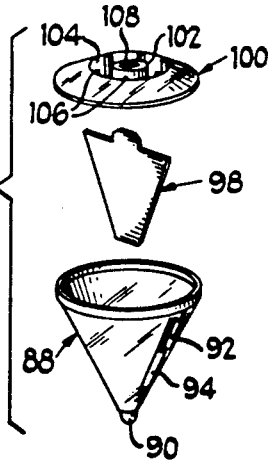
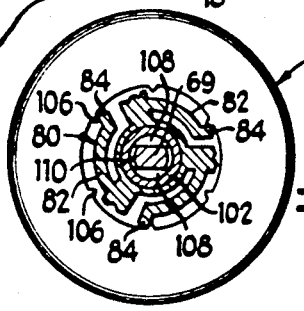
Fig 6
Fig 7
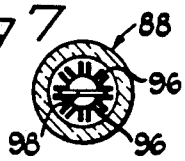

TOKEN MOVING GAME WITH SPINNING DISRUPTER

BACKGROUND OF THE INVENTION

1. Field of the Invention

This invention relates generally to games and more particularly to games in which players move tokens along a path subject to periodic disruption.

2. Background Art

There are numerous prior art games in which players race assigned tokens along a path pursuant to chance determinations. Such games have long been popular pastimes. To enhance interest in and enjoyment of such games, serpentine and/or spiral paths moving up a three dimensional structure have been used, as in Steinhardt et al. U.S. Pat. No. 907,421 issued Dec. 22, 1908. Interest in and enjoyment of path games involving a three dimensional structure have been further enhanced by random and/or player directed devices for disrupting the upward movement of the assigned tokens. Thus for example, missiles or other hazards slideably or movably related to a mountain for physically knocking off tokens are shown in Rudell et al. U.S. Pat. No. 4,333,655 issued Jun. 8, 1982; water is used to remove tokens from play in Barlow U.S. Pat. No. 4,348,028 issued Sep. 7, 1982 and in United Kingdom Patent Application 2,028,148 published Mar. 5, 1980, a whimsical animal atop the center of a three dimensional game board is operated to project a retractable piston driven shaft to capture game tokens. Hayes U.S. Pat. No. 3,649,021 issued Mar. 14, 1972 is a board game in which a ball is dropped down an upstanding central randomizing device for disrupting assigned tokens on the game path. Goldfarb et al. U.S. Pat. No. 4,206,925 issued Jun. 10, 1980 has a movable housing that is positioned at one end of a path at the beginning of a turn and from time to time a propelled wheel vehicle is released from the housing to knock down a token on the path. Zaruba et al. U.S. Pat. No. 4,852,886 discloses a game board having a spiral path along which players move one or a stack of tokens with a wind-up spring motor random moving disrupter being released from time to time to knock down the tokens. There nevertheless continues to be a need for relatively simply path games in which players move assigned tokens to reach a goal with the chance of an interesting mechanical device moving randomly along the path disrupting the players' attempts to move their tokens to the end of the path.

SUMMARY OF THE INVENTION

The present invention is concerned with providing a path game in which players move assigned tokens up a serpentine path from a start to reach a finish at the top adjacent which a releasably rotating token disrupter is housed. Chance determination, more particularly cards, govern movement of the players, assigned tokens, release of the disrupter and interplay between players. The disrupter is in the form of a rotatable top that is releasably seated, together with a winding and release mechanism, adjacent the top end of the serpentine path. Frictional engagement between the top and the winding mechanism initially attaches the top to the winding mechanism. Included in the winding and release mechanism is a downwardly movable shaft into which torsional energy is imparted by a torsion spring that is wound by rotating the top in one direction relative to the mechanism. To release the top, the shaft is pushed down until the shaft disengages the top from the mounting and imparts the torsional energy into the top resulting in the top spinning down the path. Ridges between segments of the path generally direct the spinning top down the path. However, gaps in the ridges allow the top to skip segments or go entirely off the path. There are a plurality of defined spaces along the path upon which assigned tokens are placed and there are also a limited number of relatively safe areas for the tokens formed by recesses in the ridges.

BRIEF DESCRIPTION OF THE DRAWINGS

For a better understanding of the present invention, reference may be had to the accompanying drawings in which:

FIG. 2 is an exploded perspective view of the winding and release mechanism;

FIG. 3 is an exploded perspective view of the top;

FIG. 4 is an enlarged scale, sectional view taken along line 4—4 of FIG. 1;

FIG. 5 is a sectional view taken generally along line 5—5 of FIG. 4;

FIG. 6 is a sectional view taken generally along line 6—6 of FIG. 4;

FIG. 7 is a sectional view taken generally along line 7—7 of FIG. 4;

DETAILED DESCRIPTION

Figure 1:
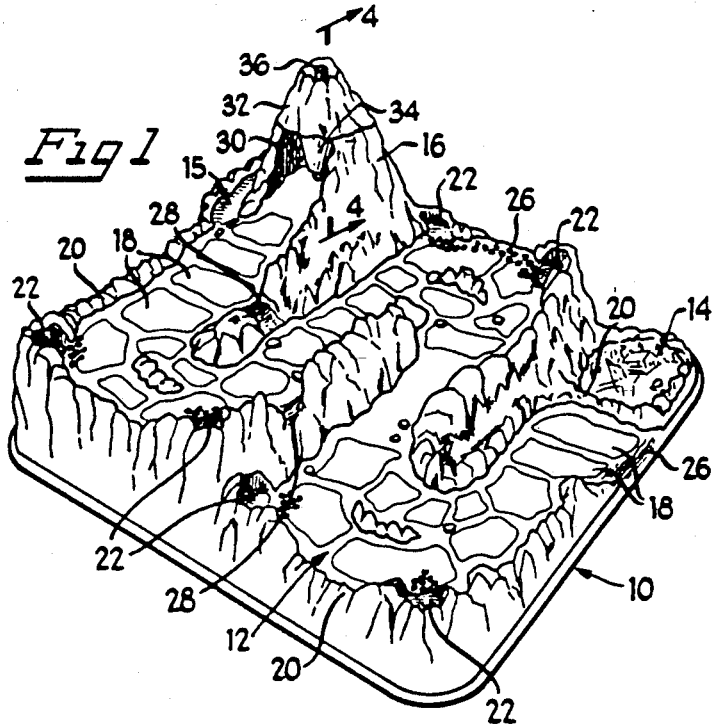
FIG. 1 is a perspective view of a three dimensional structure providing a serpentine path for a game embodying the present invention.
Figure 8:
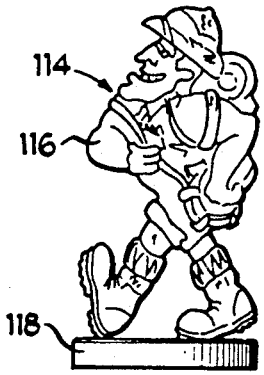
FIG. 8 is an enlarged scale elevational view of a token used in the game.

Referring now to the drawings in which like parts are designated by like reference numerals throughout the several views, there is shown in FIG. 1 a three dimensional base 10 that may conveniently be molded or vacuum formed from a suitable plastic. Base 10 includes a serpentine path 12 that leads upwardly from a base camp 14 in a lower corner of the base to a hollow summit 16 forming a hollow, open-top structure in the uppermost corner of the base. Path 12 consists of a continuous series of consecutive segments and is divided into a plurality of twenty-three to twenty-five defined spaces 18 that start adjacent base camp 14 and finish at lookout point 15 adjacent summit 16. Generally upstanding portions or ridges 20 separate segments of path 12. Disposed along path 12 are six recesses 22 in ridges 20 that form safe sites or caves. As is shown in FIG. 1, these six caves 22 are each located adjacent a bend in serpentine path 12. There are also gaps 26, and 28 that extend all the way through parts of ridges 20.

Hollow, open-top summit 16 also has an opening 30 adjacent the uppermost finish end of path 12 so that a continuation of the path leads into summit 16. Atop hollow, open-top summit 16 is a removably seatable cap 32. Depending from cap 32 for spinning release out of mouth 30 is a disrupter top 34 which is released by manual depression of button 36 extending out through the top of cap 32. It will be appreciated that as spinning disrupter top 34 is released it will be generally constrained by ridges 20 and proceed down serpentine path 12 toward base camp 14. However, top 34 should normally not enter base camp 14 in view of the upwardly projecting portion of ridge 20 disposed between base camp 14 and the beginning of serpentine path 12. The spinning top may sometimes miss segments of the serpentine path and either skip from one segment of the path to another through either or both of gaps 28 or leave base 10 completely through gap 26 between the two caves 22 on the same backside of base 10 containing base camp 14 and summit 16.

Along the open-top of summit 16 is a ledge 40 including three recesses 42 that are spaced apart at 120 degree intervals. There are three radially extending tabs 44 along the bottom edge of cap 32 that are also spaced apart at 120 degree intervals. Cap 32 is seated upon ledge 40 with one of each of tabs 44 received in a respective recess 42. Thus it will be appreciated that, while cap 32 is readily removable and reseatable in a generally vertical direction, it is keyed against rotational movement relative to summit 16. Each of tabs 44 includes a slot 46. Extending inwardly from the inside wall of cap 32, generally aligned with the center of each of tabs 44, is a pair of spaced apart, inwardly extending fins 48. A winding and release mechanism for top 34, which includes button 36, torsion spring 50, shaft 52 and anchor 54, is carried by cap 32. Adjacent the bottom edge of button 36 are three radially extending, 120 degree spaced apart, tabs 56. At least one of tabs 56 is conveniently provided with an aperture 58. One end of torsion spring 50 forms a hook 60 which is engageable in aperture 58. The other end of torsion spring 50 forms an inwardly directed pin 62. Shaft 52 has a slot 64 that extends from the top of shaft 52 throughout most of the length of the shaft 52 down to shoulder 66. Adjacent the bottom of slot 64, above shoulder 66, is a bore 68 that receives pin 62 of torsion spring 50. Below shoulder 66, shaft 52 terminates in a generally rectangular key 69.

Anchor 54 includes a tubular center portion 70. Integrally formed with center 70 are three, 120 degree spaced apart, outwardly projecting webs 72. Along the bottom of each web 72 is a flange 74 that forms a hook 76 at the end opposite center 70. A material such as polypropylene plastic is conveniently used to make anchor 54 so that the inherent resiliency of the material provides some flexibility for each of hook ends 76. As is best illustrated in FIGS. 4 and 5, anchor 54 is secured within cap 32 with the outer edge of each of webs 72 fitting in the space between each pair of fins 48 and with each hook end 76 fitting through a respective slot 46 and being biased into engagement with a respective tab 44. Depending downwardly from the upward edge of tubular center portion 70 are three, 120 degree spaced apart, notches 78 which are conveniently dimensioned to receive a respective one of tabs 56 extending from button 36. Notches 78, in cooperation with tabs 56, permit generally vertical movement of button 36, that is along the axis of tubular center portion 70, while preventing relative rotational movement between button 36 and anchor 54.

On the bottom of tubular center portion 70, is a ratchet clutch 80. As is best illustrated in FIG. 6, ratchet clutch 80 includes three, 120 degree spaced apart, arms 82. Each arm terminates in an outwardly directed free end 84. Again, because of the inherent resiliency of the material, such as polypropylene plastic, from which anchor 54 is made, and the shape of arms 82, each of the arms, or more particularly their free ends are forceable inwardly along a radially direction toward the center of anchor 54.

Top 34 has a generally conical body 88 that is conveniently made of a transparent plastic material. At the bottom of body 88 is a point 90 about which top 34 spins. In the side of conical body 88 is a cut out 92 and a projection 94 which create a sound as the top spins. On the inside of body 88, adjacent point 90, are a series of slots 96 which receive and stabilize a card insert 98 which may contain suitable graphics viewable through transparent body 88. Secured atop body 88, once card 98 is inserted, is a cover 100 which may conveniently be made of the same transparent plastic material as body 88. Cover 100 includes a central hub 102 surrounded by an annular recess 104. Along the outer wall of annular recess 104 are six detents 106 directed inwardly toward hub 102. Within hub 102 are a pair of spaced apart, oppositely angling ramps 108 that define a generally rectangular slot 110 between them. Slot 110 receives key 69 of shaft 52 with a respective elongated side of the generally rectangular key engaging a face of each of spaced apart angled ramps 108.

The outer diameter of hub 102 is conveniently dimensioned with respect to the inner diameter of tubular center portion 70 of anchor 54 so that hub 102 is insertable into the bottom of center portion 70 and there is a slight interference fit between the hub and the center tubular portion. To facilitate the interference fit and resulting frictional engagement between top 34 and anchor 54, the inside of tubular center portion 70 may be formed with a slight taper that decreases from the bottom toward the top.

With top 34 frictionally retained beneath anchor 54 and with key 69 of shaft 52 in slot 110 of top cover 100, top 34 may be rotated in a counterclockwise direction, as viewed in FIG. 6, with respect to the winding assembly mounted in cap 32. From FIGS. 4, 5 and 6, it will be appreciated that as top 34 is rotated counterclockwise, each of ratchet clutch arms 82 will bend inwardly as they engage and pass over respective detents 106. Such counterclockwise rotation of top 34 will, through the engagement of the sides of key 69 with the faces of spaced apart angled ramps 108, wind torsion spring 50. It will also be appreciated that in such counterclockwise relative rotation, the upper or higher end of each of the ramps 108 bear upon key 68. The energy stored in torsion spring 50 as it is wound is not immediately transmitted to top 34 because ratchet clutch 80 prevents the clockwise rotation of top 34 relative to anchor 54. Because of the outward angle of each free end 84 of an arm 82, when a detent 106 engages free end 84 with top 34 rotating in the clockwise direction, arm 82 is pushed outwardly and locks up against the detent rather than bending inwardly and riding over the detent as occurs when the top is rotated in the counterclockwise direction.

Depression of button 36 projecting out the top of cap 32 pushes shaft 52 down and forces top 34, or more particularly, hub 102, out of frictional engagement with anchor 54. As soon as ratchet clutch 80 is moved out of engagement with detents 106, the rotational energy stored in torsion spring 52 is transmitted through key 69 of shaft 52 into top 34 which drops down onto path 12 spinning at a high rate of speed. Angled ramps 108 facilitate key 69 riding up and out of slot 110 during clockwise rotation of top 34 relative to key 69 as viewed in FIG. 6.

Each of up to four players is provided with an assigned token 114 that is conveniently styled as depicting a hiker 116 atop a pedestal 118. Some graphic distinction such as color is used to distinguish each pair of hiker tokens 114 from each other pair.

Figure 9:
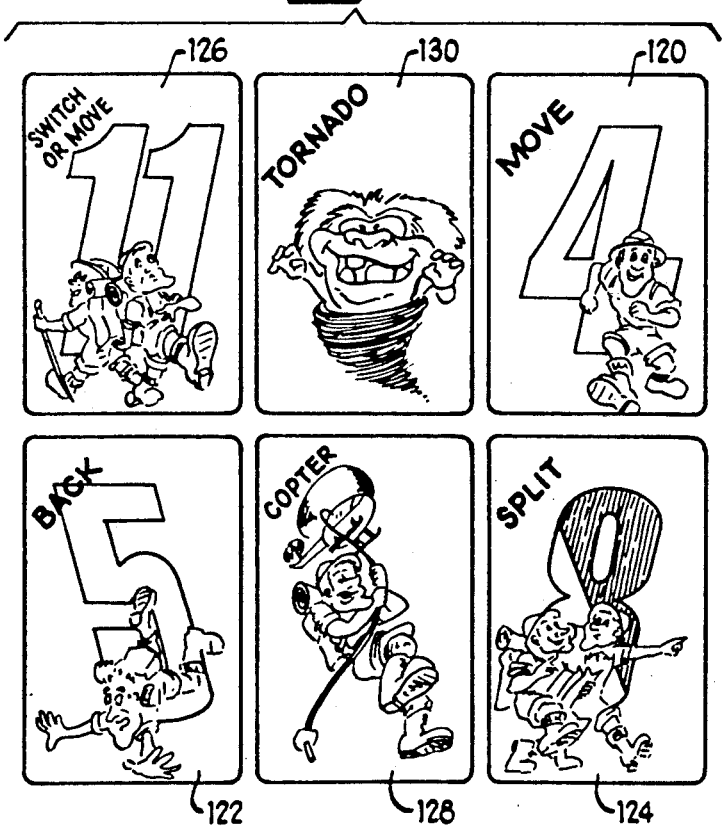
FIG. 9 is a top plan view of the face of representative cards used in the game.

The game also includes a deck of forty-six cards. In the deck are twenty-seven cards which direct the player to move an assigned token 114 an indicated number of spaces forward. The face of an exemplary card 120, that indicates the token is to be moved four spaces, is shown in FIG. 9. Other move forward cards differ from card 120 only in the number of spaces indicated. Thus, there are six "MOVE 1" cards, five "MOVE 3" cards, five "MOVE 4" cards, five "MOVE 7" cards and six "MOVE 10" cards. In addition to the move forward cards there are five move "BACK 5" cards 122, six "SPLIT 8" cards 124, five "SWITCH OR MOVE 11" cards 126, five "COPTER" cards 128 and eight "TORNADO" cards 130.

At the beginning of play each player's two assigned tokens are placed in base camp 14. If a card indicates a specific number of spaces to be moved, the general rule is that the player must move that exact number. As players move their tokens along the path they may try and selectively position the token on the defined spaces in such a way as to avoid top 34 when it comes spinning down path 12. Players are permitted to occupy a space already containing a token. While a number of tokens may occupy a space 18 in front of a cave 22, only one token may occupy a cave itself at any one time. Tokens must be removed from the upper end of the path by exact count. If a player is prohibited from moving the exact number of spaces indicated on a card then the player is forced to move as many spaces as possible. In order to win, a player must remove both assigned tokens from the finish end of path 12. A token on lookout point 15 is not subject to any card played or the effects of top 34.

"BACK 5" card 122 is used to move another player's token back five spaces which could result in the token being moved back to base camp 14. Cards 122 are thus an exception to the general rule that moves are to be made by exact count shown on the card. When a player moves an opponent's token back using card 122, the player may place the opponent's token anywhere on the defined space.

"SPLIT 8" cards 124 permit a player to split eight spaces between the player's two tokens. Accordingly, a player could move one token seven spaces and the other one, or any other combination of two moves that total eight spaces. Alternatively, a player may use card 124 to move one token the full eight spaces.

"SWITCH or MOVE ELEVEN" cards 126 permit a player to elect to either move forward eleven spaces or switch the player's token with the token of any other player on the path except for a token occupying a cave/safe site 22. A token in base camp 14 cannot be switched with another token already on path 12.

"COPTER" cards 128 permit a player to instantly move a token from base camp 14 to any defined space 18 on path 12 that is already occupied by another player's token. Card 128 is useless to a player if the player does not have a token in base camp 14.

"TORNADO" card 130 permits a player to release the "TORNADO" top disrupter 34 from summit 16 to proceed down path 12 and hopefully knock all of the opponent's tokens off the path. Card insert 98 may conveniently contain the same graphics as are on tornado card 130. When a player's token is knocked off of path 12 the token must be returned to base camp 14. However, if a token is merely knocked over so that it is no longer standing upright on pedestal 118 but nevertheless remains on path 12, the token remains where it lies on path 12. If a knocked down token lies across two defined spaces 18 it is placed on the downhill one of the two spaces at such time as the player is ready to move the token. However, when an opponent moves a player's token back using card 122 or switches with the token using card 126, the opponent may then place the token upright.

The cards are shuffled, placed face down in a pile and players in turn pick the uppermost card and immediately follow the instructions on the picked card. In the event that a player is unable to use the card picked, as for example a "COPTER" card 128 when the player has no tokens remaining in base camp 14, the player's turn ends.

While a particular embodiment of the present invention has been shown and described, variations and modifications will occur to those skilled in the art. It is intended in the appended claims to cover all such variations and modifications as fall within the true spirit and scope of the present invention.

What is claimed as new and desired to be secured by Letters Patent is:

1. A path game for a number of players comprising in combination:

a path having a start and a finish;

the start being substantially lower than the finish;

at least one token assigned to each player for moving from the start to the finish in accordance with chance determinations;

a top releasably mounted to a winding and release mechanism;

means for storing rotational energy and imparting the rotational energy to the top upon release from the winding and release mechanism; and means for removably seating the winding and release mechanism, together with the top, adjacent the finish.

2. The game of claim 1 in which:

a base contains the path; and the path has a continuous series of consecutive segments;

the base includes upwardly projecting portions that separate segments of the path.

3. The game of claim 2 including one or more recesses in the upwardly projecting portions adjacent the path.

4. The game of claim 2 including a gap in the portions permitting the spinning top to leave the base before reaching the start.

5. The game of claim 2 including gaps in the portions permitting movement of the top from one segment of the path to another, nonconsecutive segment of the path while avoiding intervening consecutive segments of the path.

6. The game of claim 5 including one or more recesses in the upwardly projecting portions adjacent the path.

7. The game of claim 5 including a gap in the portions permitting the spinning top to leave the base before reaching the start.

8. The game of claim 7 including one or more recesses in the upwardly projecting portions adjacent the path.

9. The game of claim 1 including:

a hollow, open-top structure adjacent the finish;

the structure also having an opening adjacent the finish;

a ledge formed adjacent the open-top on the structure;

a cap removably seatable on the ledge; and means for securing the winding and release mechanism to the cap.

10. The game of claim 9 in which the securing means comprises in combination:

a set of spaced apart inward extensions on an inside of the cap;

an outward projection on the winding and release mechanism; and the projection fitting between the set of spaced apart inward extensions for securing the winding and release mechanisms to the cap.

11. The game of claim 9 in which:

the ledge includes a number of recesses;

the cap includes the same number of tabs; and each of the tabs are engageable with a respective recess to prevent the cap from rotating relative to the structure.

12. The game of claim 11 in which the securing means comprises in combination:

each of the tabs having a slot;

the winding and release mechanism including the same number of resilient hooks as there are tabs; and each of the hooks being engageable with a respective slot for securing the winding and release mechanism to the cap.

13. The game of claim 11 in which the securing means comprises in combination:

a set of spaced apart inward extensions on an inside of the cap;

an outward projection on the winding and release mechanism; and the projection fitting between the set of spaced apart inward extensions for securing the winding and release mechanism to the cap.

14. The game of claim 13 in which the securing means further comprises:

each of the tabs having a slot;

the winding and release mechanism including the same number of resilient hooks as there are tabs; and each of the hooks being engageable with a respective slot for securing the winding and release mechanism to the cap.

* * * * *